US007486261B2

(12) United States Patent
Oh et al.

(10) Patent No.: US 7,486,261 B2
(45) Date of Patent: Feb. 3, 2009

(54) ELECTRO-LUMINESCENT DISPLAY DEVICE

(75) Inventors: Du Hwan Oh, Chungcheongbuk-do (KR); Hoon Ju Chung, Kyounggi-do (KR)

(73) Assignee: LG Display Co., Ltd., Seoul (KR)

( * ) Notice: Subject to any disclaimer, the term of this patent is extended or adjusted under 35 U.S.C. 154(b) by 637 days.

(21) Appl. No.: 11/023,615

(22) Filed: Dec. 29, 2004

(65) Prior Publication Data

US 2005/0237280 A1 Oct. 27, 2005

(30) Foreign Application Priority Data

Apr. 22, 2004 (KR) ..... 10-2004-0027732

(51) Int. Cl.
*G09G 3/30* (2006.01)

(52) U.S. Cl. ..... 345/76; 345/98

(58) Field of Classification Search ..... 345/76, 345/87, 96, 98, 100, 83
See application file for complete search history.

(56) References Cited

U.S. PATENT DOCUMENTS 6,333,729 B1 * 12/2001 Ha ..... 345/98
7,123,232 B1 * 10/2006 Edwards ..... 345/98
2003/0090451 A1 * 5/2003 Ahn ..... 345/96
2003/0231152 A1 * 12/2003 Shin ..... 345/83
2004/0104873 A1 * 6/2004 Kang et al. ..... 345/87
2005/0156862 A1 * 7/2005 Hirayama et al. ..... 345/100
2005/0243034 A1 * 11/2005 Chung et al. ..... 345/76

* cited by examiner

*Primary Examiner*—Amare Mengistu
*Assistant Examiner*—Yuk Chow
(74) *Attorney, Agent, or Firm*—Morgan Lewis & Bockius LLP

(57) ABSTRACT

An electro-luminescence display device includes an electro-luminescence display panel having pixel cells arranged at intersections of a plurality of data electrode lines and a plurality of scan electrode lines, the scan electrode lines being in a unit of at least two electrode lines, and each of the pixel cells along a same row being connected to at least one scan electrode line of a corresponding scan electrode line unit, and a multiplexer for selectively applying data signals to at least two of the data electrode lines during a time period.

13 Claims, 7 Drawing Sheets

ELECTRO-LUMINESCENT DISPLAY DEVICE

The present invention claims the benefit of Korean Patent Application No. P2004-27732 filed in Korea on Apr. 22, 2004, which is hereby incorporated by reference.

BACKGROUND OF THE INVENTION

1. Field of the Invention

The present invention relates to an electro-luminescence (EL) display device, and more particularly, to an electro-luminescence display device that has a reduced number of output channels of a data driving integrated circuit.

2. Discussion of the Related Art

Until recently, display devices generally employed cathode-ray tubes (CRTs) or television monitors. Presently, many efforts are being made to study and develop various types of flat panel display devices, such as liquid crystal display devices (LCDs), field emission displays (FEDs), plasma display panel (PDPs), and electro-luminescence (EL) displays, as substitutions for CRTs because of their lightness, thin profile, and compact size.

In particular, an EL display panel is a self-luminous device and does not need an additional light source to emit light. Accordingly, an EL display panel has a very thin profile. In addition, the EL display panel can operate using a low DC voltage, thereby having low power consumption and fast response time. Further, the EL display panel is an integrated device having wide viewing angle, and high image contrast, such that it has high endurance of external impacts and a wide range of applications.

There are two types of EL display panels, an inorganic EL device, which uses an inorganic compound as a phosphorous material, and an organic EL display device, which uses an organic compound as the phosphorous material. In particular, an organic EL display device includes an electron injection layer, an electron carrier layer, a light-emitting layer, a hole carrier layer and a hole injection layer. When a predetermined voltage is applied between an anode and a cathode, electrons produced from the cathode are moved via the electron injection layer and the electron carrier layer into the light-emitting layer while holes produced from the anode are moved via the hole injection layer and the hole carrier layer into the light-emitting layer. As a result, the light-emitting layer emits light by a recombination of electrons and holes fed from the electron carrier layer and the hole carrier layer.

FIG. 1 is a schematic cross-sectional view of an organic light-emitting cell of an electro-luminescence display panel according to the related art. In FIG. 1, an organic EL device includes an electron injection layer 4, an electron carrier layer 6, a light-emitting layer 8, a hole carrier layer 10, and a hole injection layer 12, which are sequentially disposed between a cathode 2 and an anode 14. The cathode 2 is a metal electrode and the anode 14 is a transparent electrode.

If a voltage is applied between the anode 14 and the cathode 2, electrons produced from the cathode 2 are moved, via the electron injection layer 4 and the electron carrier layer 6, into the light-emitting layer 8 while holes produced from the anode 14 are moved, via the hole injection layer 12 and the hole carrier layer 10, into the light-emitting layer 8. Thus, the electrons and the holes fed from the electron carrier layer 6 and the hole carrier layer 10, respectively, collide and are recombined at the light-emitting layer 8 to generate light. Then, light is emitted, via the transparent electrode (i.e., the anode 14), to an exterior of the EL device to thereby display a picture.

FIG. 2 is a schematic block diagram of an electro-luminescence display device according to the related art. In FIG. 2, an EL display device includes an EL display panel 16 having pixel cells 22 arranged at pixel areas defined by intersections between scan electrode lines SL1 to SLn and data electrode lines DL1 to DLm, a scan driver integrated circuit 18, hereinafter referred to as "scan D-IC", for driving the scan electrode lines SL1 to SLn, a data driver integrated circuit 20, hereinafter referred to as "data D-IC", for driving the data electrode lines DL1 to DLm, and a timing controller 28 for controlling driving timings of the scan D-IC 18 and the data D-IC 20.

In addition, each of the pixel cells 22 includes a light-emitting cell OLED connected between a supply voltage source VDD and a ground voltage source GND, and a light-emitting cell driving circuit 30 for driving the light-emitting cell OLED in response to a driving signal from a corresponding one of the data electrode lines DL and a scanning signal from a corresponding one of the scan electrode lines SL. The light-emitting cell driving circuit 30 includes a driving thin film transistor (TFT) DT connected between the supply voltage source VDD and the light-emitting cell OLED, a first switching element TFT T1 connected to the scan electrode line SL and the data electrode line DL, a second switching element TFT T2 connected to the first switching element TFT T1 and the driving TFT DT, a converter TFT MT connected between a node positioned between the first and second switching element TFTs T1 and T2 and the supply voltage source VDD to form a current mirror circuit with respect to the driving TFT DT, thereby converting a current into a voltage, and a storage capacitor Cst connected between a gate terminal of each of the driving TFT DT and the converter TFT MT and the supply voltage source VDD. Herein, the TFT is a p-type electron metal-oxide semiconductor field effect transistor (MOSFET).

A gate terminal of the driving TFT DT is connected to the gate terminal of the converter TFT MT, a source terminal of the driving TFT DT is connected to the supply voltage source VDD, and a drain terminal of the driving TFT DT is connected to the light-emitting cell OLED. A source terminal of the converter TFT MT is connected to the supply voltage source VDD, and a source terminal of the converter TFT MT is connected to a drain terminal of the first switching element TFT T1 and a source terminal of the second switching element TFT T2. A source terminal of the first switching element TFT T1 is connected to the data electrode line DL, and a drain terminal of the first switching element TFT T1 is connected to a source terminal of the second switching element TFT T2. A drain terminal of the second switching element TFT T2 is connected to the gate terminal of the driving TFT DT, the gate terminal of the converter TFT MT and the storage capacitor Cst. A gate terminal of the first switching element TFT T1 and a gate terminal of the second switching element TFT T2 are connected to a respective scan electrode line. Meanwhile, if the converter TFT MT and the driving TFT DT have same characteristics, the converter TFT MT and the driving TFT DT form a current mirror circuit such that a current amount flowing in the converter TFT MT equals to a current amount flowing in the driving TFT DT.

The timing controller 28 generates a data control signal for controlling the data D-IC 20 and a scan control signal for controlling the scan D-IC 18 using synchronizing signals supplied from an external system (e.g. a graphic card). Further, the timing controller 28 applies a data signal from the external system to the data D-IC 20.

The scan D-IC 18 generates scanning pulses SP in response to the scanning control signal from the timing controller 28, and applies the scanning pulses SP to the scan electrode lines SL1 to SLn as shown in FIG. 3 to sequentially drive the scan electrode lines SL1 to SLn.

The data D-IC 20 supplies current signals having a current level or a pulse width responding to data signals to the data electrode lines DL1 to DLm every horizontal period 1H in response to the data control signal from the timing controller 28. In this case, the data D-IC 20 has DLm output channels 21 that are matched with the data electrode lines DL1 to DLm in a relationship of one to one.

The EL display device applies current signals having a current level or a pulse width proportional to an input data to the pixel cells 22. Each of the pixel cells 22 is light-emitted in proportion to an amount of current fed from the data electrode line DL.

In the EL display device according to the related art, the data D-IC 20 and the data electrode lines DL1 to DLm are in an one-to-one matching relationship, i.e., the data D-IC 20 includes m output channels connecting to m date electrode lines DL1 to DLm. Thus, such a data D-IC having m output channels increases fabrication costs and requires more space of accommodating m output channels. As a undesired result, a size of the EL display device becomes larger.

SUMMARY OF THE INVENTION

Accordingly, the present invention is directed to an electro-luminescence display device that substantially obviates one or more of the problems due to limitations and disadvantages of the related art.

An object of the present invention to provide an electro-luminescence display device that has a reduced number of output channels of a data driving integrated circuit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electro-luminescence display device includes an electro-luminescence display panel having pixel cells arranged at intersections of a plurality of data electrode lines and a plurality of scan electrode lines, the scan electrode lines being in a unit of at least two electrode lines, and each of the pixel cells along a same row being connected to at least one scan electrode line of a corresponding scan electrode line unit, and a multiplexer for selectively applying data signals to at least two of the data electrode lines during a time period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
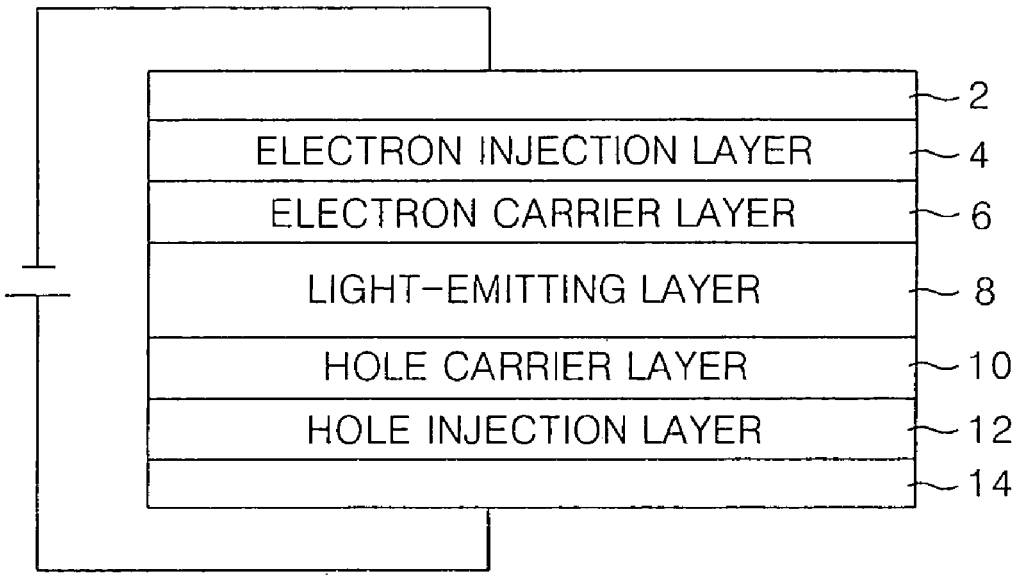
FIG. 1 RELATED ART
FIG. 1 is a schematic cross-sectional view of an organic light-emitting cell of an electro-luminescence display panel according to the related art.
Figure 2:
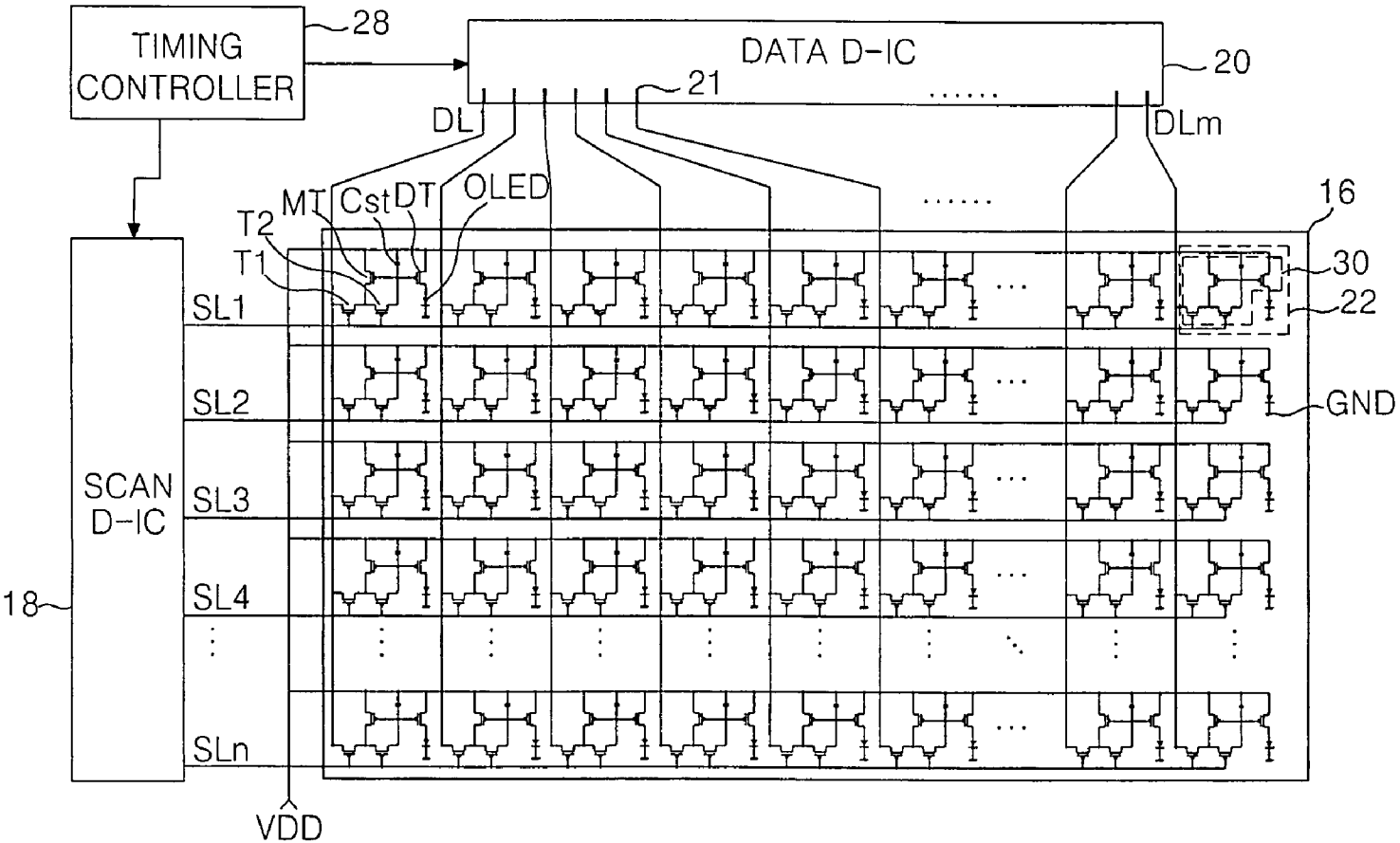
FIG.2 RELATED ART
FIG. 2 is a schematic block diagram of an electro-luminescence display device according to the related art.
Figure 3:
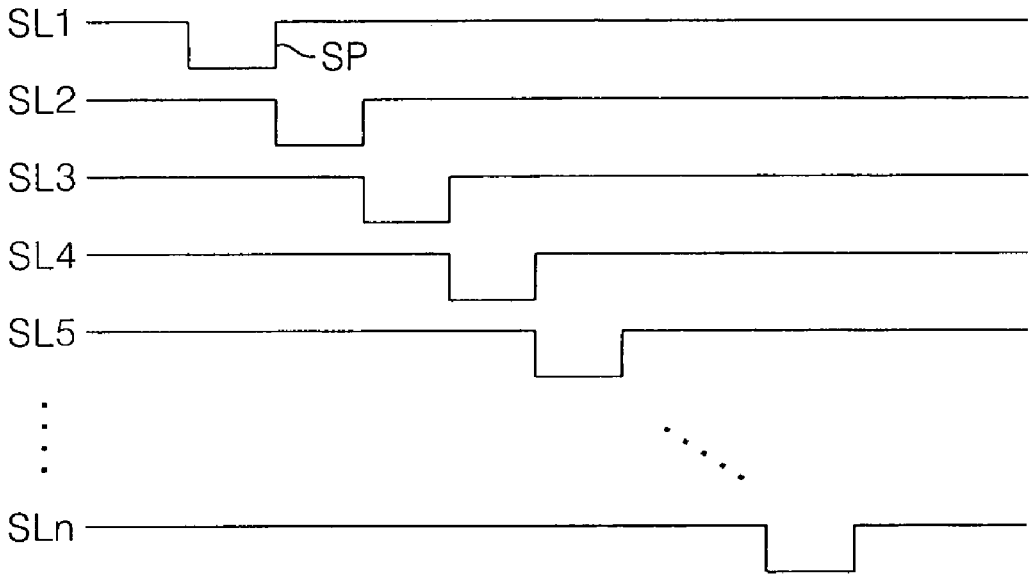
FIG. 3 RELATED ART
FIG. 3 is a waveform diagram of a scanning pulse applied to the scan electrode line shown in FIG. 2.
Figure 4:
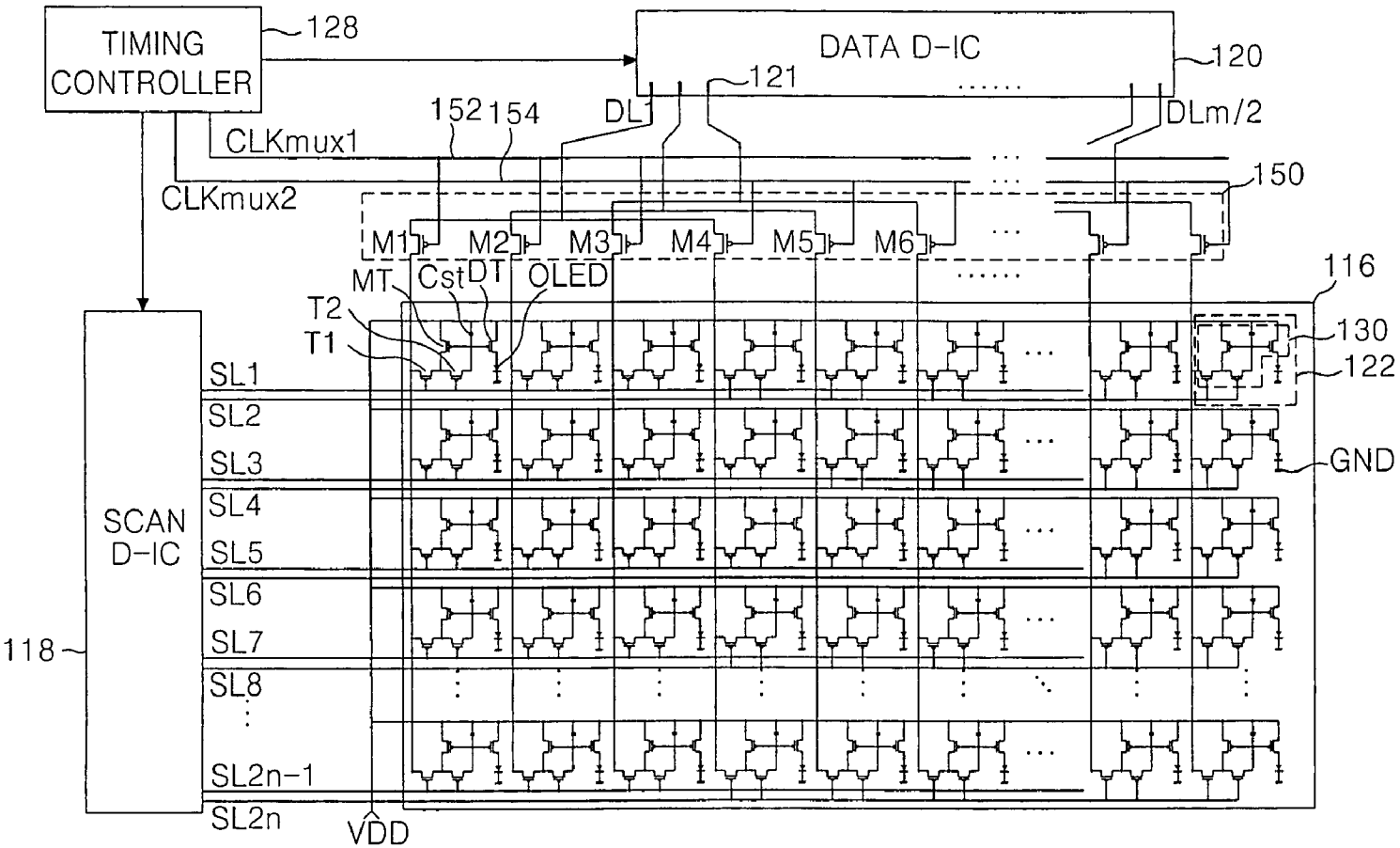
FIG. 4 is a block diagram showing a configuration of an electro-luminescence display device according to an embodiment of the present invention.

FIG. 4 is a block diagram showing a configuration of an electro-luminescence display device according to an embodiment of the present invention. In FIG. 4, an EL display device may include an EL display panel 116, a scan integrated circuit ("scan D-IC") 118, a data integrated circuit ("data D-IC") 120, a multiplexer part 150, and a timing controller 128. The EL display panel 116 may include a plurality of scan electrode lines SL1 to SL2*n* (where n is an integer) formed along a first direction, and a plurality of data electrode lines DL1 to DLm (where m is an integer) formed along a second direction crossing the scan electrode lines SL1 to SL2*n*. The plurality of scan electrode lines SL1 to SL2*n* may be grouped into a unit of two, such that n-by-m number of pixel areas may be defined by the crossing of the scan electrode lines SL1 to SL2*n* and the data electrode lines DL1 to DLm. A plurality of pixel cells 122 may be formed in these pixel areas.

In addition, the scan electrode scan lines SL1 to SL2*n* may be driven by the scan D-IC 118, and the data electrode lines DL1 to DLm may be driven by the data D-IC 120. The multiplexer part 150 may selectively connect a respective one of output channels of the data D-IC 120 to j data electrode lines DL1 to DLj, where j is an integer greater than two. The timing controller 128 may control timings for driving the scan D-IC 118, the data D-IC 120 and the multiplexer part 150, respectively.

Further, the pixel cells 122 along a same row may be grouped into a unit of k number of the pixel cells 122, where k is an integer greater than two. The pixel cells 122 of a same unit may be located consecutively along a same row. The odd-numbered pixel cell units may be connected to a odd-numbered scan electrode line, e.g., one of the scan electrode lines SL1, SL3 . . . SL2*n*-3 and SL2*n*-1, and the even-numbered pixel cell units may be connected to an even-numbered scan electrode line, e.g., one of the SL2, SL4 . . . SL2*n*-2 and SL2*n*. As a result, the pixel cell units along a same row may be connected alternatively to a respective odd-numbered scan electrode line and a respective even-numbered scan electrode line in a zigzag manner. For example, k may equal to three and red-color, green-color and blue-color pixel cells 122 along a row may be grouped in a same pixel cell unit. In particular, the pixel cell units along a same row may be connected alternatively to the respective odd-numbered scan electrode line and the respective even-numbered scan line in a zigzag manner. For instance, first, second and third pixel cells along the first row of the panel 116 may be connected to the first scan electrode line SL1. Further, fourth, fifth and sixth pixel cells along the first row may be connected to the second scan electrode line SL2, while seventh, eighth and ninth pixel cells along the first row also may be connected to both the first scan electrode line SL1.

Each of the pixel cells 122 may include a light-emitting cell OLED connected between a supply voltage source VDD and a ground voltage source GND, and a light-emitting cell driving circuit 130 for driving the light-emitting cell OLED in response to a driving signal supplied from a respective one of the data electrode lines DL1 to DLm and a respective one of the scan electrode lines SL1 to SL2*n*.

Moreover, the light-emitting cell driving circuit 130 may include a driving thin film transistor (TFT) DT connected between the supply voltage source VDD and the light-emitting cell OLED, a first switching element TFT T1 connected to a respective scan electrode line SL and a respective data electrode line DL, a second switching element TFT T2 connected to the first switching element TFT T1 and the driving TFT DT, a converter TFT MT connected to a node between the first and second switching element TFTs T1 and T2 and connected to the supply voltage source VDD to form a current mirror circuit with respect to the driving TFT DT. In particular, the driving TFT DT, the first switching element TFT, the second switching element TFT, and the converter TFT MT may include a p-type electron metal-oxide semiconductor field effect transistor (MOSFET).

In addition, the light-emitting cell driving circuit 130 also may include a storage capacitor Cst connected to the supply voltage source VDD and to a gate terminal of each of the driving TFT DT and the converter TFT MT. The gate terminal of the driving TFT DT also may be connected to the gate terminal of the converter TFT MT, a source terminal of the driving TFT DT may be connected to the supply voltage source VDD, and a drain terminal of the driving TFT DT may be connected to the light-emitting cell OLED. Further, a source terminal of the converter TFT MT may be connected to the supply voltage source VDD, and a drain terminal of the converter TFT MT may be connected to a drain terminal of the first switching element TFT T1 and a source terminal of the second switching element TFT T2. A source terminal of the first switching element TFT T1 may be connected to the respective data electrode line DL, and the drain terminal of the first switching element TFT T1 may be connected to the source terminal of the second switching element TFT T2. A drain terminal of the second switching element TFT T2 may be connected to the gate terminal of the driving TFT DT, the gate terminal of the converter TFT MT, and the storage capacitor Cst. A gate terminal of the first switching element TFT T1 and a gate terminal of the second switching element TFT T2 may be connected to the respective scan electrode line SL.

As a result, a converter TFT MT may form a current mirror circuit with respect to the driving TFT DT. If the converter TFT MT and the driving TFT DT have the same characteristics, then a current amount flowing in the converter TFT MT may become equal to a current amount flowing in the driving TFT DT. Such an EL display device according to an embodiment of the present invention applies current signals having a current level or a pulse width proportional to an input data to the pixel cells 122. Each of the pixel cells 122 may emit light in proportion to an amount of current fed from the respective data electrode line DL.

The timing controller 128 may generate a data control signal for controlling the data D-IC 120 and a scan control signal for controlling the scan D-IC 118 using synchronizing signals supplied from an external system, e.g. a graphic card. The timing controller 128 also may apply a data signal from the external system to the data D-IC 120. Subsequently, the scan D-IC 118 may generate a scanning pulse SP in response to the scanning control signal received from the timing controller 128, and the data D-IC 120 may generate current signals having a current level or a pulse width responding to the data signal received from the timing controller 128.

Further, the timing controller 128 may apply first and second selection signals, CLKmux1 and CLKmux2, to the multiplexer part 150. The first and second selection signals CLKmux1 and CLKmux2 may have different values. For example, the first selection signal CLKmux1 may be at a low state LOW when a scanning pulse SP is applied to the odd-numbered scan electrode lines SL1, SL3 to SL2*n*-1, and may be at a high state HIGH when the scanning pulse SP is applied to the even-numbered scan electrode lines SL2, SL4 to SL2*n*. In addition, the second selection signal CLKmux2 may be at a high state HIGH when the scanning pulse SP is applied to the odd-numbered scan electrode lines SL1, SL3 to SL2*n*-1, and may be at a low state LOW when the scanning pulse SP is applied to the even-numbered scan electrode lines SL2, SL4 to SL2*n*.

Moreover, the multiplexer part 150 may include first to third switching devices M1, M2 and M3 respectively connected to the first to third data electrode lines DL1, DL2 and DL3 and connected to the odd-numbered scan electrode lines SL1, SL3 to SL2*n*-1. The multiplexer part 150 may also include fourth to sixth switching devices M4, M5 and M6 respectively connected to the fourth to sixth data electrode lines DL4, DL5 and DL6 and connected to the even-numbered scan electrode lines SL2, SL4 to SL2*n*. The first to third switching devices M1 to M3 and the fourth to sixth switching devices M4 to M6 may be alternatively arranged.

In addition, the first to third switching devices M1, M2 and M3 may be connected to a first selection signal supply line 152 for receiving the first selection signal CLKmux1 from the timing controller 128. The fourth to sixth switching devices M4, M5 and M6 may be connected to a second selection signal supply line 154 for receiving the second selection signal CLKmux2 from the timing controller 128. Further, the first and fourth switching devices M1 and M4 may be connected to the same output channel 121, while the second and fifth switching devices M2 and M5 may be connected to the same output channel 121, and the third and sixth switching devices M3 and M6 may be connected to the same output channel 121. For example, the data D-IC 120 may have m/2 number of output channels 121 and each of the output channels 121 may be connected, via the switching devices M1 and M4, M2 and M5 or M3 and M6, to two of the data electrode lines DL1 to DLm. As a result, the multiplexer part 150 may selectively connect each of the output channels 121 of the data D-IC 120 to two of the data electrode lines DL1 to DLm in response to the first and second selection signals CLKmux1 and CLKmux2 from the timing controller 128.

Figure 5:
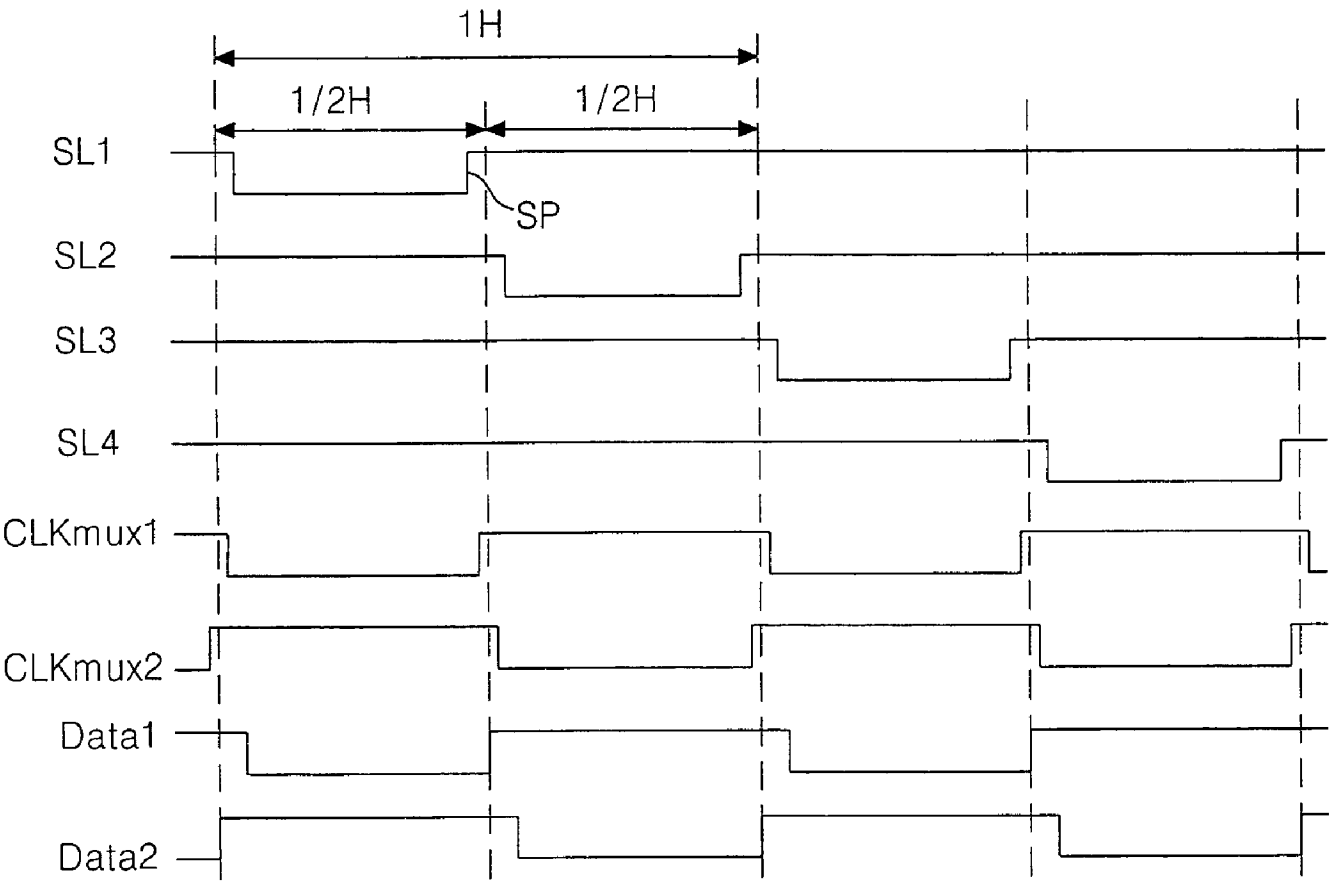
FIG. 5 is a waveform diagram of a scanning pulse, a selection signal and a data signal applied to the device shown in FIG. 4.

FIG. 5 is a waveform diagram of a scanning pulse, a selection signal and a data signal applied to the device shown in FIG. 4. As shown in FIG. 5, a low state of the scanning pulse SP may be applied sequentially to the scan electrode lines SL1 to SL2*n* by the scan D-IC 118 (shown in FIG. 4), to thereby sequentially drive the scan electrode lines SL1 to SL2*n*. A width of the scanning pulse SP may correspond to a half of one horizontal period 1H, and the scanning pulse SP having a pulse width of H/2 may be sequentially applied to the scan electrode lines SL1 to SL2*n*. In addition, the current signals may be applied to the data electrode lines DL1 to DLm by the data D-IC 120 (shown in FIG. 4) in response to the data control signal from the timing controller 128 (shown in FIG. 4).

During a period when the scanning pulse SP is LOW and is applied to one of the odd-numbered scan electrode lines SL1, SL3 to SL2*n*-1, the first selection signal CLKmux1 also may be LOW to turn on the first to third switching devices M1, M2 and M3 (shown in FIG. 4), thereby applying current signals outputted via the output channels 121 of the data D-IC 120 to the data electrode lines DL corresponding to the pixel cells 122 connected to the odd-numbered scan electrode lines SL1, SL3 to SL2*n*-1. In addition, during a period when the scanning pulse SP is LOW and is applied to one of the even-numbered scan electrode lines SL2, SL4 to SL2*n*, the second selection signal CLKmux2 also may be LOW to turn on the fourth to sixth switching devices M4, M5 and M6 (shown in FIG. 4), thereby applying current signals outputted via the output channels 121 of the data D-IC 120 to the data electrode lines DL corresponding to the pixel cells 122 connected to the even-numbered scan electrode lines SL2, SL4 to SL2*n*.

As a result, the first to third switching devices M1, M2 and M3 of the multiplexer part 150 may be turned on, when the scanning pulse SP applied to one of the odd-numbered scan electrode lines SL1, SL3 to SL2*n*-1 is LOW. The fourth to sixth switching devices M4, M5 and M6 of the multiplexer part 150 may be turned on when the scanning pulse SP applied to one of the even-numbered scan electrode lines SL2, SL4 to SL2*n* is LOW. Thus, current signals may be applied to the pixel cells 122 connected to the odd-numbered scan electrode lines SL1, SL3 to SL2*n*-1 using the first to third switching devices M1, M2 and M3 of the multiplexer part 150 during a first half of one horizontal period, and current signals may be applied to the pixel cells 122 connected to the even-numbered scan electrode lines SL2, SL4 to SL2*n* using the fourth to sixth switching devices M4, M5 and M6 of the multiplexer part 150 during a second half of one horizontal period.

In the EL display device according to the above-described embodiment of the present invention, the output channels 121 of the data D-IC 120 and the data electrode lines DL1 to DLm may be in an one-to-two matching along a column direction, to thereby reduce the number of the output channels 121 of the data D-IC 120 corresponding to the number of the data electrode lines DL1 to DLm by a half. Accordingly, a fabrication cost is reduced, a size of the data D-IC 120 also is lessened, and a size of the EL display panel 116 is decreased.

Figure 6:
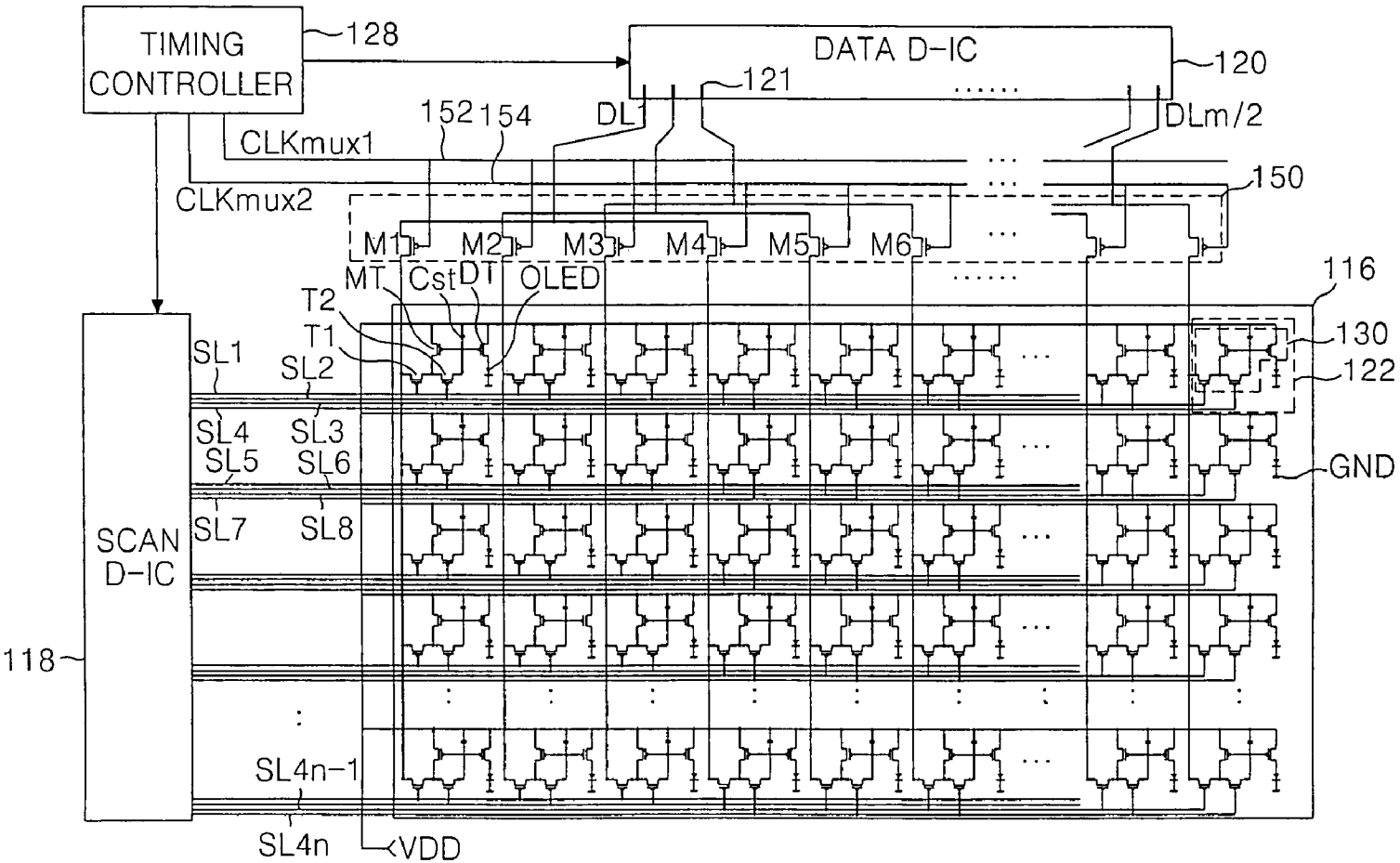
FIG. 6 is a block diagram showing a configuration of an electro-luminescence display device according to an embodiment of the present invention.

FIG. 6 is a block diagram showing a configuration of an electro-luminescence display device according to an embodiment of the present invention. In FIG. 6, an EL display device may include an EL display panel 116, a scan integrated circuit ("scan D-IC") 118, a data integrated circuit ("data D-IC") 120, a multiplexer part 150, and a timing controller 128. The EL display panel 116 may include a plurality of scan electrode lines SL1 to SL4*n* (where n is an integer) formed along a first direction, and a plurality of data electrode lines DL1 to DLm (where m is an integer) formed along a second direction crossing the scan electrode lines SL1 to SL4*n*. The plurality of scan electrode lines SL1 to SL4*n* may be grouped into a unit of four, such that n-by-m number of pixel areas may be defined by the crossing of the scan electrode lines SL1 to SL4*n* and the data electrode lines DL1 to DLm. A plurality of pixel cells 122 may be formed in these pixel areas.

In addition, the scan electrode scan lines SL1 to SL4*n* may be driven by the scan D-IC 118, and the data electrode lines DL1 to DLm may be driven by the data D-IC 120. The multiplexer part 150 may selectively connect a respective one of output channels of the data D-IC 120 to j data electrode lines DL1 to DLj, where j is an integer greater than two. Further, the timing controller 128 may control timings for driving the scan D-IC 118, the data D-IC 120 and the multiplexer part 150, respectively.

Each of the pixel cells 122 may be connected to two of the scan electrode lines SL1 to SL4*n* and the pixel cells 122 of a same row may be grouped into a unit of k number of the pixel cells 122, where k is an integer greater than two. In particular, the pixel cells 122 of a same unit may be located consecutively along a same row and may be connected to the same two scan electrode lines. In addition, the pixel cell units along a same row may be alternatively connected to one of two groups of two scan electrode lines in a zigzag manner. For example, k may be three, and all first, second and third pixel cells along the first row of the panel 116 may be connected to both the first and second scan electrode lines SL1 and SL2. Further, all fourth, fifth and sixth pixel cells along the first row may be connected to both the third and fourth scan electrode lines SL3 and SL4, while all seventh, eighth and ninth pixel cells along the first row also may be connected to both the first and second scan electrode lines SL1 and SL2.

Further, each of the pixel cells 122 may include a light-emitting cell OLED connected between a supply voltage source VDD and a ground voltage source GND, and a light-emitting cell driving circuit 130 for driving the light-emitting cell OLED. The light-emitting cell driving circuit 130 may include a driving thin film transistor (TFT) DT connected between the supply voltage source VDD and the light-emitting cell OLED, a first switching element TFT T1 connected to a first respective scan electrode line and a respective data electrode line, a second switching element TFT T2 connected to a second respective scan electrode, the first switching element TFT T1 and the driving TFT DT, a converter TFT MT connected to a node between the first and second switching element TFTs T1 and T2 and connected to the supply voltage source VDD to form a current mirror circuit with respect to the driving TFT DT.

In particular, a gate terminal of the first switching element TFT T1 and a gate terminal of the second switching element TFT T2 may be connected to a different one of the scanning electrode lines SL1 to SL4*n*. For example, the gate terminal of the first switching element TFT T1 of the first pixel cell along the first row of the panel 116 (shown in FIG. 6) may be connected to the first scanning electrode line SL1 and the gate terminal of the second switching element TFT T2 of the same pixel cell, i.e., the first pixel cell along the first row of the panel 116 (shown in FIG. 6) may be connected to the second scanning electrode line SL2. In addition, the gate terminal of the first switching element TFT T1 of each pixel cell of the odd-numbered pixel cell units along the first row of the panel 116 (shown in FIG. 6) may be connected to the first scanning electrode line SL1, while the gate terminal of the second switching element TFT T2 of each pixel cell of the even-numbered pixel cell units along the first row may be connected to the second scanning electrode line SL2.

Figure 7:
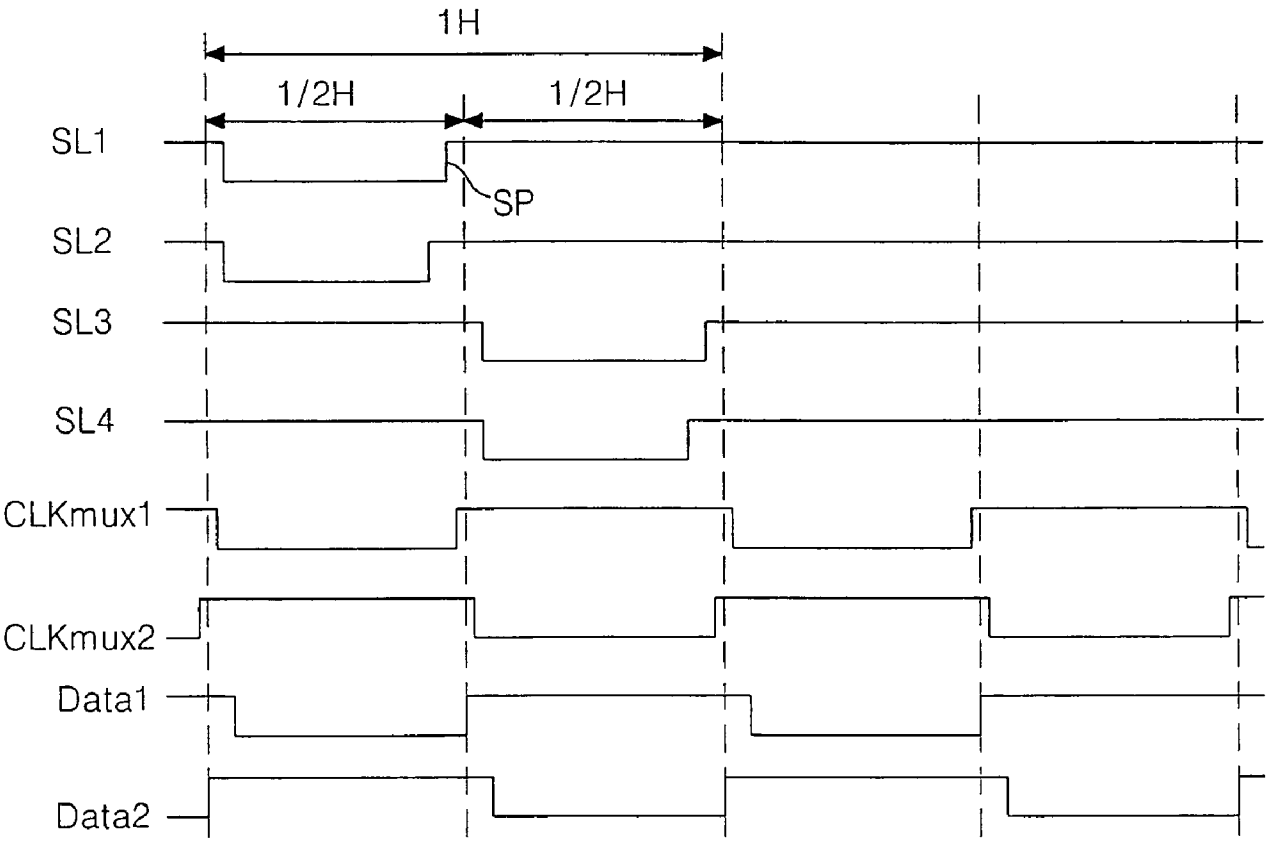
FIG. 7 is a waveform diagram of a scanning pulse, a selection signal and a data signal applied to the device shown in FIG. 6.

FIG. 7 is a waveform diagram of a scanning pulse, a selection signal and a data signal applied to the device shown in FIG. 6. As shown in FIG. 7, a low state of the scanning pulse SP may be applied first to the first two of the scan electrode lines SL1 to SL4*n* by the scan D-IC 118 (shown in FIG. 6), and then to the next two of the scan electrode lines SL1 to SL4*n*. A width of the scanning pulse SP may correspond to a half of one horizontal period 1H, and the scanning pulse SP having a pulse width of H/2 may be applied to two of the scan electrode lines SL1 to SL4*n* at a time. In addition, during a same half horizontal period H/2, a width of the low-state scanning pulse SP applied to the first switching element TFT T1 may be shorter than a width of the low-state scanning SP applied to the second switching element TFT T2 of a same pixel cell, to thereby turning off the first switching element TFT T1 before turning off the second switching element TFT T2. As a result, the first and second switching element TFTs T1 and T2 may be turned off sequentially within a same half horizontal period H/2 to maintain a voltage stored in a storage capacitor Cst of the pixel cell 122.

Although not shown, the EL display devices of the present invention are not limited to a one-to-two matching of the output channels 121 of the data D-IC 120 with respect to the data electrode lines DL1 to DLm as mentioned above, but may be a n-to-m matching thereof (wherein n is any ones of the output channels 121 of the data D-IC 120, and m is an integer greater than two, which is the number of the data electrode lines). Further, the multiplexer part 150 also may include switching devices corresponding to a n-to-m matching of the output channels 121 of the data D-IC 120 with respect to the data electrode lines DL1 to DLm.

As described above, the EL display device according to the present invention provides the EL display panel with the multiplexer part for making a n-to-m matching (wherein n is 1, and m is an integer larger than n) of the output channels of the data D-IC with respect to the data electrode lines, and has the pixel cells connected to the odd-numbered and even-numbered scan electrode lines in a zigzag type. Accordingly, it becomes possible to reduce the number of output channels of the data D-IC corresponding to the number of data electrode lines by a half. Furthermore, it becomes possible to reduce a cost of the data driver integrated circuit and to manufacture a compact EL display panel.

It will be apparent to those skilled in the art that various modifications and variations can be made in the electro-luminescence display device of the present invention without departing from the spirit or scope of the invention. Thus, it is intended that the present invention covers the modifications and variations of this invention provided they come within the scope of the appended claims and their equivalents.

What is claimed is:

1. An electro-luminescence display device, comprising:

an electro-luminescence display panel having pixel cells arranged at intersections of a plurality of data electrode lines and a plurality of scan electrode lines, the scan electrode lines being in a unit of two electrode lines, and each of the pixel cells along a same row being connected to one scan electrode line of a corresponding scan electrode line unit in a zigzag manner;

a multiplexer for selectively applying data signals to at least two of the data electrode lines during a half of one horizontal period;

a data driving circuit for applying the data signals to the multiplexer; and a controller for applying at least first and second selection signals to the multiplexer, wherein the number of the data electrode lines is m, m being an integer, and the data driving circuit includes m/2 output channels connecting to the multiplexer, wherein the multiplexer includes at least a first switching device and a second switching device, the first switching device being connected to the output channels and the data electrode lines connecting to the pixel cells connected to odd-numbered ones of the scan electrode lines, and the second switching device being connected to the output channels and the data electrode lines connecting to the pixel cells connected to even-numbered ones of the scan electrode lines, wherein the pixel cells are in a unit of k number of pixel cells, k being an integer more than one, and the pixel cell units along a same row are connected to one of the odd-numbered and even-numbered scan electrode lines of the corresponding scan electrode line unit in a zigzag manner, and wherein the first switching device connects the output channels to the data electrode lines connecting to the pixel cells connected to the odd-numbered scan electrode lines in response to the first selection signal from the controller, and the second switching device connects the output channels to the data electrode lines connecting to the pixel cells connected to the even-numbered scan electrode lines in response to the second selection signal from the controller.

2. The electro-luminescence display device according to claim 1, wherein the first selection signal is in an ON state and the second selection signal is in an OFF state during about a first half of the time period, and the first selection signal is in an OFF state and the second selection signal is in an ON state during about a second half of the time period.

3. The electro-luminescence display device according to claim 2, further comprising a scan driving circuit applied scanning pulses to the scan electrode lines, wherein the scanning pulses sequentially being in an ON state within a half of the time period, thereby sequentially driving the scan electrode lines.

4. The electro-luminescence display device according to claim 3, wherein each of the pixel cells includes a current driving pixel cell.

5. The electro-luminescence display device according to claim 4, wherein each of the pixel cells includes:

a light-emitting cell connected between a supply voltage source and a ground voltage source;

a driving switch connected to the supply voltage source and the light-emitting cell;

a first switching element connected to a respective one of the scan electrode lines and a respective one of the data electrode lines;

a converter switch connected to the supply voltage source and the first switching element and forming a current mirror circuit along with the driving switch;

a second switching element connected to a node between the driving switch and the converter switch, the first switching element and the respective scan electrode line; and a capacitor connected between the node between the driving switch and the converter switch and the supply voltage source.

6. The electro-luminescence display device according to claim 5, wherein the first and second switching elements are turned off at about the same time.

7. The electro-luminescence display device according to claim 1, wherein the multiplexer is in the electro-luminescence display panel.

8. An electro-luminescence display device, comprising:

an electro-luminescence display panel having pixel cells arranged at intersections of a plurality of data electrode lines and a plurality of scan electrode lines, the scan electrode lines being in a unit of four electrode lines, and each of the pixel cells along a same row being connected to two scan electrode lines of the corresponding scan electrode line unit in a zigzag manner;

a multiplexer for selectively applying data signals to at least two of the data electrode lines during a half of one horizontal period;

a data driving circuit for applying the data signals to the multiplexer and a controller for applying at least first and second selection signals to the multiplexer, wherein the number of the data electrode lines is m. m being an integer, and the data driving circuit includes m/2 output channels connecting to the multiplexer, wherein the pixel cells are in a unit of k number of pixel cells, k being an integer more than one, and the pixel cell units along a same row are connected to either first and second scan electrode lines or third and fourth scan electrode lines of the corresponding scan electrode line unit in a zigzag manner, and wherein the multiplexer includes at least a first switching device and a second switching device, the first switching device being connected to the output channels and the data electrode lines connecting to the pixel cells connected to the first and second scan electrode lines of the scan electrode line units, and the second switching device being connected to the output channels and the data electrode lines connecting to the pixel cells connected to third and fourth scan electrode lines of the scan electrode line units.

9. The electro-luminescence display device according to claim 8, wherein the first switching device connects the output channels to the data electrode lines connecting to the pixel cells connected to the first and second scan electrode lines of the scan electrode line units in response to the first selection signal from the controller, and the second switching device connects the output channels to the data electrode lines connecting to the pixel cells connected to the third and fourth scan electrode lines of the scan electrode line units in response to the second selection signal from the controller.

10. The electro-luminescence display device according to claim 9, wherein the first selection signal is in an ON state and the second selection signal is in an OFF state during about a first half of the time period, and the first selection signal is in an OFF state and the second selection signal is in an ON state during about a second half of the time period.

11. The electro-luminescence display device according to claim 10, further comprising a scan driving circuit applied scanning pulses to the scan electrode lines, wherein two of the scanning pulses sequentially being in an ON state within a half of the time period, thereby driving the scan electrode lines in a unit of two scan electrode lines sequentially.

12. The electro-luminescence display device according to claim 11, wherein each of the pixel cells includes:

a light-emitting cell connected between a supply voltage source and a ground voltage source;

a driving switch connected to the supply voltage source and the light-emitting cell;

a first switching element connected to a first respective one of the scan electrode lines and a respective one of the data electrode lines;

a converter switch connected to the supply voltage source and the first switching element and forming a current mirror circuit along with the driving switch;

a second switching element connected to a node between the driving switch and the converter switch, the first switching element and a second respective one of the scan electrode a capacitor connected between the node between the driving switch and the converter switch and the supply voltage source.

13. The electro-luminescence display device according to claim 12, wherein the first and second switching elements are sequentially turned off within a half of the time period.

* * * * *